United States Patent [19]

Keyworth et al.

[11] 4,181,536

[45] Jan. 1, 1980

[54] PROCESS FOR THE CLEANING OF FOULED HEAT EXCHANGERS AND OTHER EQUIPMENT

[75] Inventors: Donald A. Keyworth, Houston; Jerome R. Sudduth, Pasadena, both of Tex.

[73] Assignee: Tenneco Chemicals, Inc., Saddle Brook, N.J.

[21] Appl. No.: 967,036

[22] Filed: Dec. 6, 1978

[51] Int. Cl.[2] ..... B08B 3/08; B08B 9/00

[52] U.S. Cl. ..... 134/2; 134/22 R; 134/26; 134/42

[58] Field of Search ..... 134/2, 22 R, 22 C, 26, 134/42; 165/5, 95; 208/48 R, 48 AA; 122/401; 260/438.1

[56] References Cited

U.S. PATENT DOCUMENTS

| | | | |
|---|---|---|---|
| 3,647,843 | 3/1972 | Walker et al. | 260/438.1 |
| 3,651,159 | 3/1972 | Long et al. | 260/438.1 X |
| 3,857,869 | 12/1974 | Turnbo | 260/438.1 |
| 4,099,984 | 7/1978 | Christenson et al. | 134/2 |

*Primary Examiner*—Marc L. Caroff

*Attorney, Agent, or Firm*—Evelyn Berlow

[57] ABSTRACT

Heat exchangers and other equipment whose surfaces have become fouled with sludge deposits during the use of the equipment in the removal of carbon monoxide, lower olefins, or other complexible ligands from gas streams with a liquid sorbent that comprises a cuprous aluminum tetrahalide and an aromatic hydrocarbon solvent are cleaned by contacting the fouled surfaces of the equipment with an aqueous ammonium chloride solution to dissolve and/or loosen substantially all of the deposited sludge, washing the surfaces with water to remove loosened sludge and residual cleaning solution, and drying them.

7 Claims, No Drawings

PROCESS FOR THE CLEANING OF FOULED HEAT EXCHANGERS AND OTHER EQUIPMENT

This invention relates to a process for the cleaning of heat exchangers, column packing surfaces, and other equipment that have become fouled while being used during the removal of carbon monoxide, lower olefins, or other complexible ligands from gas streams by the use of a liquid sorbent that comprises a cuprous aluminum tetrahalide and an aromatic hydrocarbon.

Bimetallic salt complexes that have the generic formula $M_IM_{II}X_n$ Aromatic, wherein $M_I$ is a Group I-B metal, $M_{II}$ is a Group III-A metal, X is halogen, n is the sum of the valences of $M_I$ and $M_{II}$, and Aromatic is a monocyclic aromatic hydrocarbon having 6 to 12 carbon atoms, are known to be useful in the separation from gas mixtures of such complexible ligands as olefins, acetylenes, aromatics, and carbon monoxide. For example, in U.S. Pat. No. 3,651,159, Long et al. disclosed a process in which a sorbent solution of cuprous aluminum tetrahalide in toluene was used to separate ethylene, propylene, and other complexible ligands from a feedstream. The complexed ligands were recovered by ligand exchange with toluene. The resulting solution of cuprous aluminum tetrahalide.toluene in toluene was recycled and used to separate additional quantities of the complexible ligands from the feed stream. Walker et al. in U.S. Pat. No. 3,647,843 disclosed a process in which a hydrocarbon pyrolysis gas stream was contacted with a cuprous aluminum tetrachloride solution in toluene to separate acetylene from the gas stream as a solution of the complex $HC{\equiv}CH.CuAlCl_4$ in toluene. Acetylene was stripped from this complex, and the cuprous aluminum tetrachloride toluene complex was recycled.

In processes such as those disclosed by Long et al. and Walker et al. in which a liquid sorbent that comprises a cuprous aluminum tetrahalide complex is recycled without purification and used for long periods of time, there is a gradual increase in the amounts of reaction by-products and other impurities in the liquid sorbent until there is sufficient impurity present to interfere with the efficient operation of the process. For example, when the liquid sorbent is contacted with a gas stream that contains an olefin having 2 to 4 carbon atoms, some of the olefin undergoes polymerization to form olefin oligomers, and some reacts with the aromatic hydrocarbon in the liquid sorbent to form polyalkylated aromatic compounds. Small amounts of water, hydrogen sulfide, alcohols, ethers, ketones, amines, and certain other impurities in the gas stream react with the cuprous aluminum tetrahalide complex to form complexes. These reaction by-products and complexes have limited solubility in the sorbent, and they tend to precipitate from the sorbent in the cooler parts of the processing equipment, thereby forming sludge deposits that coat heat exchangers and column packing surfaces, clog lines, and otherwise foul the equipment. When this occurs, it is necessary to purify or discard the liquid sorbent and to remove the sludge deposits from the equipment.

The procedures that have been used heretofore for the removal of sludge deposits from heat exchangers and other equipment are not entirely satisfactory because they are time-consuming and costly to carry out, they cause degradation of the liquid sorbent, or their use results in serious pollution problems. For example, hydroblasting in which the sludge deposits are contacted with water or steam under high pressure requires relatively long periods of down-time and its use may result in sorbent degradation. The treatment of the deposits with hot toluene does not usually remove a sufficient amount of the sludge from the equipment surfaces, and it makes necessary solvent recovery and purification procedures. In U.S. Pat. No. 4,099,984, Christenson et al. disclosed a process for cleaning fouled heat exchangers that comprises circulating through them a cleaning solution that contains 20% to 80% by weight of a cuprous aluminum tetrahalide.solvent complex and 1% to 15% by weight of an aluminum trihalide for 96 hours or more to remove sludge to the extent possible. Because of its high metal content, the aluminum trihalide-containing liquid sorbent that has been used to clean heat exchangers cannot be discharged into sewers or waste ponds without causing serious pollution problems. Rather, it must be treated by filtration, centrifugation, decantation, or other known methods that will remove solid impurities from it and by more costly and time-consuming procedures to remove the dissolved impurities from it or to recover the metals that it contains.

In accordance with this invention, an improved process has been developed for cleaning heat exchangers and other processing equipment that have become fouled as the result of contact between the surfaces of the equipment and a liquid sorbent that comprises a solution in an aromatic hydrocarbon solvent of a bimetallic salt complex having the structural formula $M_I.M_{II}X_n$.Aromatic, which is usually a cuprous aluminum tetrahalide.Aromatic complex. As compared with the previously-known processes for the cleaning of equipment that has been fouled in this way, the present process is simpler, faster, and more economical to operate, it removes more of the foulants from the equipment, and it does not create pollution problems or require the use of multistep procedures for the disposal or purification of the cleaning solutions that contain the sludge that was removed from the fouled equipment.

The sludge deposits that are removed from fouled processing equipment by the process of this invention contain major amounts of cuprous chloride or bromide and the complex $CuAlX_4.AlOX$ and minor amounts of AlOX, alkylated aromatic compounds, olefin oligomers, and other $CuAlX_4$ complexes, wherein each X represents halogen, preferably chlorine.

In the practice of this invention, the fouled surfaces of the heat exchangers and other processing equipment are contacted with an aqueous ammonium chloride solution for a time sufficient to loosen and/or dissolve substantially all of the deposited sludge. The loosened sludge and the cleaning solution are then removed by washing the equipment with water. After drying, the clean equipment is returned to service.

In a preferred embodiment of the invention, the liquid sorbent that has been used to remove complexible ligands from a gas stream is removed from the fouled equipment by draining and pressure blowing. The last traces of the liquid sorbent are removed by washing the surfaces of the equipment with an aromatic hydrocarbon solvent that is preferably benzene or toluene. After the equipment has been dried, an aqueous ammonium chloride solution is circulated through it until substantially all of the sludge on the surfaces of the equipment has been loosened or dissolved. The ammonium chloride solution is removed, and water is circulated through the equipment to remove loosened sludge and residual ammonium chloride solution from it. The clean equipment is then dried, for example, by purging with hot nitrogen or by treatment with high pressure steam followed by purging with nitrogen at a temperature between 50° C. and 110° C.

When a heat exchanger that has been cleaned in this way is returned to service, its efficiency, which has been reduced by fouling, is normal, that is, there is the normal temperature differential (ΔT) and pressure drop acorss the exchanger.

The aqueous ammonium chloride solutions that are used to remove sludge deposits from fouled heat exchangers and other processing equipment contain from 2% to 35%, preferably 10% to 15%, by weight of ammonium chloride. The amount of the aqueous ammonium chloride solution that is used is not critical, provided that the amount of ammonium chloride present is at least equivalent to the total amount of cuprous and aluminum salts in the sludge deposits. In most cases, the amount of cleaning solution used is that which will provide an excess of 10% to 1000% of ammonium chloride over the amount that will react with the metal salts in the sludge.

The cleaning step is ordinarily carried out by circulating the cleaning solution through the fouled equipment at a temperature in the range of 0° C. to 50° C., preferably 20° C. to 40° C., for a time sufficient to dissolve or loosen substantially all of the deposited sludge. After removal of the cleaning solution from them, the treated portions of the equipment are washed with water at 10° C. to 80° C., preferably 20° C. to 40° C., and dried.

While the mechanism by which the aqueous ammonium chloride solution removes the sludge deposits is not fully understood, it is believed that the cuprous and aluminum salts in the sludge are dissolved in the cleaning solution and that complex reactions occur between the other components of the sludge and the ammonium chloride which result in the leaching out of the bulk of the sludge deposits and the loosening of the residue.

Following their use in the process of this invention, the aqueous ammonium chloride solutions can be treated by conventional methods to recover the copper and, if desired, aluminum from them. For example, copper can be recovered by treating the cleaning solution with hydrochloric acid and powdered aluminum. For reasons of economy, the dissolved aluminum salts are ordinarily discarded. Like the aluminum salts, the other components of the sludge can be safely discarded in waste ponds.

In addition to providing a fast, safe, and inexpensive procedure for the cleaning of fouled equipment, the process of this invention has the advantage of using as cleaning solution an aqueous ammonium chloride solution which is a buffer that removes rapidly any hydrogen chloride that has formed as a by-product of the reaction between cuprous aluminum tetrachloride and water, thereby reducing the corrosivity of the sludge deposits.

The invention is further illustrated by the following examples.

EXAMPLE 1

A heat exchanger that had become fouled with sludge deposits during operation of a process in which a liquid sorbent that was a solution of cuprous aluminum tetrachloride toluene in toluene was used to remove carbon monoxide from a gas stream was cleaned by the following procedure:

After removal of the liquid sorbent from it, the heat exchanger was washed with toluene to remove residual liquid sorbent and then blown dry with hot nitrogen. A 10% aqueous ammonium chloride solution was circulated through the tubes of the heat exchanger for 24 hours and then drained from it. The heat exchanger was washed with water at ambient temperature and dried by passing hot nitrogen through it.

When the heat exchanger, which on visual inspection appeared to be clean, was returned to service, it was found that its heat transfer characteristics (ΔT) and the pressure drop across it had returned to their normal values.

EXAMPLE 2

A fouled heat exchanger was drained to remove from it a liquid sorbent that comprised cuprous aluminum tetrachloride toluene and toluene, washed by circulating benzene through it, and dried by passing nitrogen through it.

A saturated aqueous solution of ammonium chloride was circulated through the heat exchanger for 36 hours at ambient temperature and then removed from it. The heat exchanger was flushed with water at ambient temperature and dried by passing hot nitrogen through it.

When returned to service, the clean heat exchanger was found to have regained its normal efficiency.

The ammonium chloride solution that had been used to clean the heat exchanger was treated with hydrochloric acid and powdered aluminum. The spongy metallic copper that precipitated was recovered, and the filtrate, which contained ammonium salts and aluminum salts, was discarded.

What is claimed is:

1. The process for cleaning heat exchangers and other processing equipment whose surfaces have become fouled with sludge deposits during the passage through said equipment of a liquid sorbent that comprises a cuprous aluminum tetrahalide and an aromatic hydrocarbon solvent that comprises the steps of contacting the portions of the equipment that contain said sludge deposits with a cleaning solution that is an aqueous solution that contains from 2% to 35% by weight of ammonium chloride at a temperature in the range of 0° C. to 50° C. until substantially all of the deposited sludge has been dissolved or loosened from said surfaces, washing said portions of the equipment with water at a temperature in the range of 10° C. to 80° C. to remove loosened sludge and residual cleaning solution, and drying said portions of the equipment.

2. The process of claim 1 wherein the cleaning solution is an aqueous solution that contains 10% to 15% by weight of ammonium chloride.

3. The processof claim 1 wherein the fouled portions of the equipment are contacted with the cleaning solution at a temperature in the range of 20° C. to 40° C.

4. The process of claim 1 wherein the fouled portions of the equipment are washed with an aromatic hydrocarbon solvent and dried before being contacted with said cleaning solution.

5. The process of claim 1 wherein the portions of the equipment that have been contacted with said cleaning solution are washed with water at a temperature in the range of 20° C. to 40° C. and dried.

6. The process of claim 1 wherein the amount of cleaning solution used is that which contains an amount of ammonium chloride that is at least equivalent to the total amount of cuprous salts and aluminum salts in the sludge deposits.

7. The process of claim 1 wherein the amount of cleaning solution used is that which will provide an excess of 10% to 1000% of ammonium chloride over the amount that will react with the metal salts in the sludge deposits.

* * * * *